US005190639A

United States Patent [19]

Swart et al.

[11] Patent Number: 5,190,639

[45] Date of Patent: Mar. 2, 1993

[54] MULTIPLE FIXED-BED REFORMING UNITS SHARING COMMON MOVING BED REACTOR

[75] Inventors: Gerrit S. Swart, Westfield; Paul W. Kamienski, Basking Ridge, both of N.J.; Stuart S. Goldstein, Ewell, Surrey, England

[73] Assignee: Exxon Research and Engineering Company, Florham Park, N.J.

[21] Appl. No.: 805,332

[22] Filed: Dec. 9, 1991

[51] Int. Cl.[5] ..... C10G 59/02

[52] U.S. Cl. ..... 208/65; 208/63; 208/64

[58] Field of Search ..... 208/65

[56] References Cited

U.S. PATENT DOCUMENTS

| | | | |
|---|---|---|---|
| 3,640,818 | 2/1972 | Hamner | 208/65 |
| 3,748,255 | 7/1973 | Cassidy et al. | 208/65 |
| 3,748,256 | 7/1973 | Ko et al. | 208/65 |
| 3,748,259 | 7/1973 | Cassidy et al. | 208/65 |
| 3,864,240 | 2/1975 | Stone | 208/65 |
| 3,883,418 | 5/1975 | Drehmann | 208/65 |
| 3,992,465 | 11/1976 | Juguin et al. | 208/65 |
| 4,155,843 | 5/1979 | Gallagher | 208/65 |
| 4,167,473 | 9/1979 | Sikonia | 208/64 |
| 4,206,035 | 6/1980 | Hutson, Jr. et al. | 208/65 |
| 4,737,262 | 4/1988 | Franck et al. | 208/65 |
| 4,808,457 | 2/1989 | Nyan | 208/65 |
| 4,832,821 | 5/1989 | Swan, III | 208/65 |
| 4,872,867 | 10/1989 | Clem | 208/65 |
| 4,975,178 | 12/1990 | Chen et al. | 208/65 |
| 4,992,158 | 2/1991 | Schweizer | 208/65 |

*Primary Examiner*—Helane E. Myers
*Attorney, Agent, or Firm*—Henry E. Naylor

[57] ABSTRACT

A reforming system for reforming gasoline boiling range hydrocarbon streams, which system is comprised of two or more parallel fixed-bed reforming stages sharing a common moving-bed reforming stage.

7 Claims, 1 Drawing Sheet

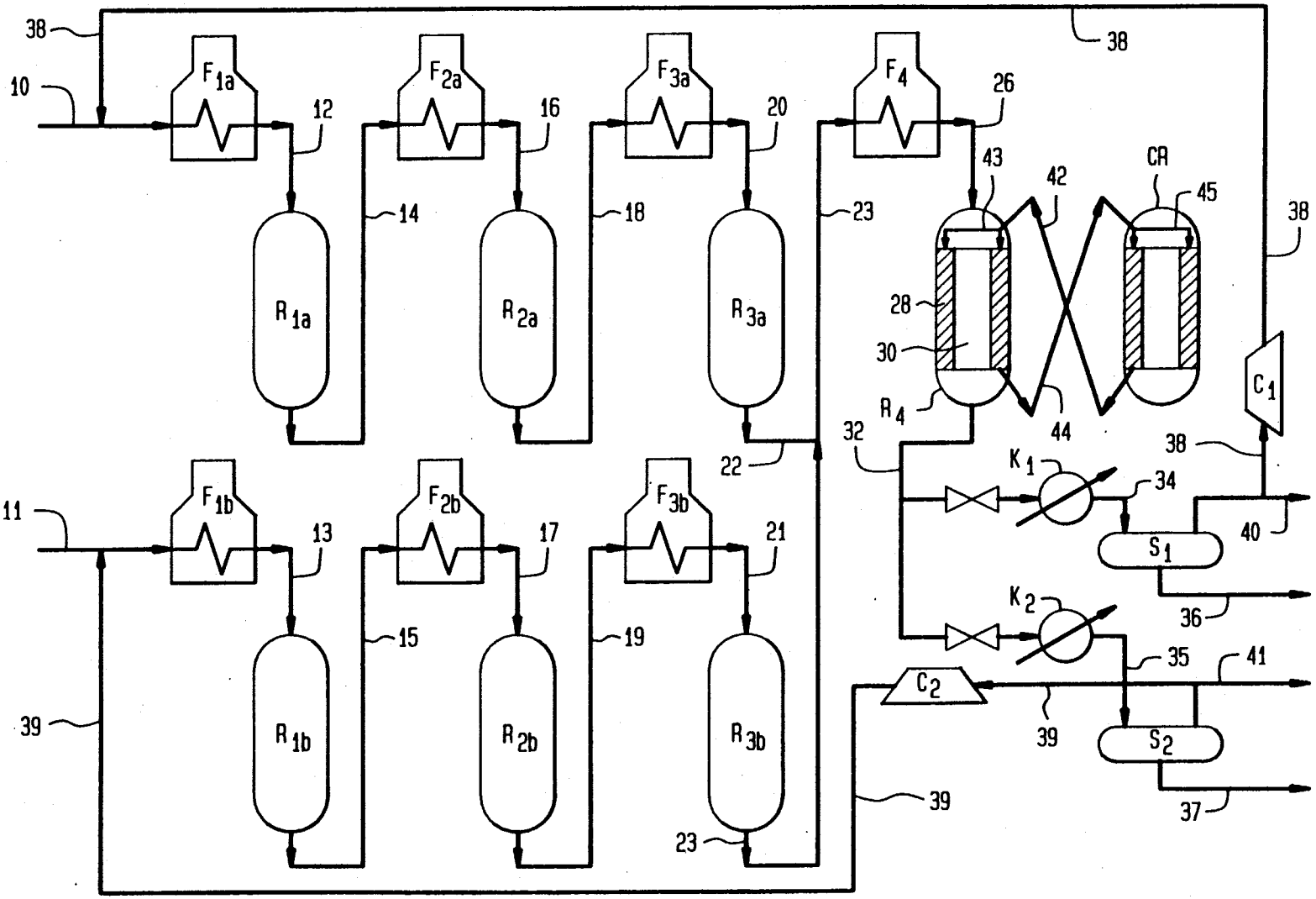
38
C1
40
41
45
CR
38
34
S1
36
35
S2
37
42
44
K1
K2
39
26
43
F4
28
30
R4
32
C2
39
23
20
R3a
22
21
R3b
23
F3a
F3b
18
19
16
R2a
17
R2b
F2a
F2b
14
15
12
R1a
13
R1b
F1a
F1b
38
10
11
39

MULTIPLE FIXED-BED REFORMING UNITS SHARING COMMON MOVING BED REACTOR

FIELD OF THE INVENTION

The present invention relates to a reforming system for reforming gasoline boiling range hydrocarbon streams, which system is comprised of two or ore parallel fixed-bed reforming stages sharing a common moving-bed reforming stage.

BACKGROUND OF THE INVENTION

Catalytic reforming is a well established refinery process for improving the octane quality of naphthas or straight run gasolines. Reforming can be defined as the total effect of the molecular changes, or hydrocarbon reactions, produced by dehydrogenation of cyclohexanes, dehydroisomerization of alkylcyclopentanes, and dehydrocyclization of paraffins and olefins to yield aromatics: isomerization of substituted aromatics; and hydrocracking of paraffins which produces gas, and inevitably coke, the latter being deposited on the catalyst. In catalytic reforming, a multifunctional catalyst is usually employed which contains a metal hydrogenation-dehydrogenation (hydrogen transfer) component, or components, usually platinum, substantially atomically dispersed on the surface of a porous, inorganic oxide support, such as alumina. The support, which usually contains a halide, particularly chloride, provides the acid functionality needed for isomerization, cyclization, and hydrocracking reactions.

Reforming reactions are both endothermic and exothermic, the former being predominant, particularly in the early stages of reforming with the latter being predominant in the latter stages. In view thereof, it has become the practice to employ a reforming unit comprised of a plurality of serially connected reactors with provision for heating the reaction stream as it passes from one reactor to another. There are three major types of reforming: semi-regenerative, cyclic, and continuous. Fixed-bed reactors are usually employed in semi-regenerative and cyclic reforming, and moving-bed reactors in continuous reforming. In semi-regenerative reforming, the entire reforming process unit is operated by gradually and progressively increasing the temperature to compensate for deactivation of the catalyst caused by coke deposition, until finally the entire unit is shut-down for regeneration and reactivation of the catalyst. In cyclic reforming, the reactors are individually isolated, or in effect swung out of line, by various piping arrangements. The catalyst is regenerated by removing coke deposits, and then reactivated while the other reactors of the series remain on stream. The "swing reactor" temporarily replaces a reactor which is removed from the series for regeneration and reactivation of the catalyst, which is then put back in the series. In continuous reforming, the reactors are moving-bed reactors, as opposed to fixed-bed reactors, with continuous addition and withdrawal of catalyst. The catalyst descends the reactors in an annular bed and is passed for regeneration to a regeneration zone where at least a portion of the accumulated carbon is burned-off. The regenerated catalyst is recycled to the reactor and the cycle is continued.

With the gradual phasing out of lead from the gasoline pool and with the introduction of premium grade lead-free gasoline in Europe and the United States, petroleum refiners must re-evaluate how certain refinery units are run to meet this changing demand for higher octane fuels without the use of lead. Because catalytic reforming units produce product streams which represent the heart of the gasoline pool, demands are being put on these units for generating streams with ever higher octane ratings.

U.S. Pat. No. 3,992,465 teaches a two stage reforming process wherein the first stage is comprised of at least one fixed-bed reforming zone and the second stage is comprised of a moving-bed reforming zone. The teaching of U.S. Pat. No. 3,992,465 is primarily to subject the reformate, after second stage reforming to a series of fractionations and an extractive distillation of the $C_6$–$C_7$ cut to obtain an aromatic-rich stream.

Therefore, there still remains a need in the art for improved reforming processes that can take advantage of the moving-bed reactor design without the need for a new grass roots unit.

SUMMARY OF THE INVENTION

In accordance with the present invention, there is provided an improved process for catalytically reforming a gasoline boiling range hydrocarbon reactant stream in the presence of hydrogen in a reforming process unit comprised of a plurality of serially connected reforming zones wherein each of the reforming zones contains at least one reforming catalyst containing a Group VIII noble metal on a refractory support. The catalyst may be either monofunctional or bifunctional. The improved process comprises:

(a) reforming reactant streams in a first reforming stage which is comprised of two separate fixed-bed reforming process units each unit comprised of one or more serially connected reforming zones containing a fixed-bed of a catalyst comprised of at least one Group VIII noble metal on a refractory support, which one or more reforming zones are operated at reforming conditions which includes a pressure of about 100 to 500 psig;

(b) passing the resulting effluent streams from both of the two fixed-bed reforming units to a second reforming stage comprised of one or more serially connected reforming zones which are operated in a moving-bed continual catalyst regeneration mode wherein the catalyst descends through the reforming zones, exits, and is passed to a regeneration zone where at least a portion of any accumulated carbon is burned-off, and wherein the regenerated catalyst is recycled to the one or more second stage reforming zones;

(c) passing a first portion of the effluent stream from said second stage reforming to a first separation zone wherein a hydrogen-rich gaseous stream and a predominantly $C_5$+ liquid stream are produced, wherein a portion of the hydrogen-rich gaseous stream is recycled to one of the fixed-bed reforming process units, and the remaining portion is collected as product gas, and (d) passing a second portion of said effluent stream from said second stage reforming to a second separation zone wherein a hydrogen-rich gaseous stream and a predominantly $C_5$+ liquid stream are produced, and wherein a portion of the hydrogen-rich gaseous stream is recycled to the other fixed-bed reforming process unit, and the remaining portion is collected as product gas.

In preferred embodiments, the Group VIII noble metal for catalysts in all stages is platinum.

In still other preferred embodiments of the present invention, the catalyst of the second stage is comprised of platinum and tin on a spherical alumina support material.

BRIEF DESCRIPTION OF THE FIGURE

The sole FIGURE hereof depicts a simplified flow diagram of a preferred reforming process of the present invention. The reforming process unit is comprised of a first stage which includes two fixed-bed process units operating independently, and wherein the effluent stream from each of the fixed-bed units is passed to a second reforming stage contains a moving-bed continuous catalyst regeneration reforming and regeneration zone.

DETAILED DESCRIPTION OF THE INVENTION

Feedstocks, also sometimes referred to herein as reactant streams, which are suitable for reforming in accordance with the instant invention are any hydrocarbonaceous feedstocks boiling in the gasoline range. Nonlimiting examples of such feedstocks include the light hydrocarbon oils boiling from about 70° F. to about 500° F., preferably from about 180° F. to about 400° F., for example straight run naphthas, synthetically produced naphthas such as coal and oil-shale derived naphthas, thermally of catalytically cracked naphthas, hydrocracked naphthas, or blends or fractions thereof.

Referring to the sole Figure hereof, gasoline boiling range hydrocarbon reactant streams, which are preferably first hydrotreated by any conventional hydrotreating method to remove undesirable components such as sulfur and nitrogen, are passed to a first reforming stage represented by two parallel banks of heaters, or preheat furnaces $F_{1a}$, $F_{2a}$, $F_{3a}$, and $F_{1b}$, $F_{2b}$, and $F_{3b}$ and reactors $R_{1a}$, $R_{2a}$, $R_{3a}$ and $R_{1b}$, $R_{2b}$, and $R_{3b}$ respectively. A reforming stage, as used herein, is any one or more reforming zones of the same type, in this figure reactors, and its associated equipment (e.g., preheat furnaces etc.). That is, a reforming stage will be represented by one or more fixed-bed reactors and another reforming stage as one or more moving-bed reactors. The parallel reforming units set forth in the Figure hereof would represent two existing reforming units which are already in-place in a refinery. The reactant streams are fed into heaters, or preheat furnaces, $F_{1a}$, and $F_{1b}$ via lines 10 and 11 respectively where they are heated to an effective reforming temperature. That is, to a temperature high enough to initiate and maintain dehydrogenation reactions, but no so high as to cause excessive hydrocracking. The heated reactant streams are then fed, via lined 12 and 13, into reforming zones $R_{1a}$, and $R_{1b}$ which contain catalyst suitable for reforming. Reforming zones $R_{1a}$, and $R_{1b}$, as well as all the other reforming zones in this first stage, are operated at reforming conditions. Typical reforming operating conditions for the reactors of this first fixed-bed stage include temperatures from about 800° to about 1200° F.; pressures from about 100 psig to about 500 psig, preferably from about 150 psig to about 300 psig; a weight hourly space velocity (WHSV) of about 0.5 to about 20, preferably from about 0.75 to about 5 and a hydrogen to oil ratio of about 1 to 10 moles of hydrogen per mole of $C_5$+ feed, preferably 1.5 to 5 moles of hydrogen per mole of $C_5$+ feed.

The effluent streams from reforming zones $R_{1a}$, and $R_{1b}$ are fed to preheat furnaces $F_{2a}$, and $F_{2b}$ via lines 14 and 15, then to reforming zones $R_{2a}$, and $R_{2b}$ via line 16 and 17, then through preheat furnaces $F_{3a}$, and $F_{3b}$ via lines 18 and 19, then to reforming zones $R_{3a}$, and $R_{3b}$ via lines 20 and 21. The effluent streams from this first stage reforming are sent to the second reforming stage via lines 22 and 23 by passing it to furnace $F_4$. The heated reaction stream from furnace $F_4$ is passed to reforming zones $R_4$ via line 26, which reforming zone is operated in a continual moving-bed mode. Such reforming zones, or reactors, are well known in the art and are typical of those taught in U.S. Pat. Nos. 3,652,231; 3,856,662; 4,167,473; and 3,992,465 which are all incorporated herein by reference. The general principle of operation of such reforming zones is that the catalyst is contained in a annular bed formed by spaced cylindrical screens located in the interior of the reactor. The reactant stream is processed through the catalyst bed, typically in an out-to-in radial flow, that is, it enters the reactor at the top and flows radially from the reactor wall through the annular bed of catalyst 28 which is descending the reactor, and passes into the cylindrical space 30 created by said annular bed. Reforming conditions for the moving-bed reforming zones will include temperatures from about 800° F. to about 1000° F.; pressures from about 100 psig to about 500 psig, preferably from about 150 psig to about 300 psig, a weight hourly space velocity (WHSV) of about 0.5 to about 20, preferably from about 0.75 to about 5 and a hydrogen to oil ratio of about 1 to 10 moles of hydrogen per mole of $C_5$+ feed, preferably about 1.5 to 5 moles of hydrogen per mole of $C_5$+ feed.

The effluent stream from reforming zone $R_4$ is passed via line 32 to cooling zones $K_1$ and $K_2$, where the temperature of the stream is dropped to about 100° to 300° F., preferably from about 100° to 175° F. Cooling zones $K_1$ and $K_2$ and separation zones $S_1$ and $S_2$ are used because they will already be part of the two fixed-bed reforming units. Thus, the effluent stream from reforming zone $R_4$ will be split to satisfy the recycle gas requirements for each of the fixed-bed reforming process units. The cooled effluent streams are then passed into separation zones $S_1$ and $S_2$ via lines 34 and 35 where they are each separated into a light hydrogen-rich $C_4$− gaseous stream, and a $C_5$+ liquid stream. The $C_5$+ streams are collected for blending in the gasoline pool via lines 36 and 37. The hydrogen-rich $C_4$+ streams are also spit, with a portion being recycled via lines 338 and 39 through compressor $C_1$ and $C_2$ to bring the pressure of the recycle streams to the process pressure of first stage reforming for each respective process unit. The other portion is sent via lines 40 and 41 as product gas.

Fresh or regenerated catalyst is charged to reforming zone $R_4$ by way of line 42 and distributed in the annular moving bed 36 by means of catalyst transfer conduits 43, the catalyst being processed downwardly as an annular dense-phase moving bed. The reforming catalyst charged to reforming zone $R_4$ is comprised of at least one Group VIII noble metal, preferably platinum; and one or more promoter metals, preferably tin, on spherical particles of a refractory support, preferably alumina. The spherical particles will have an average diameter of about 1 to 3 mm, preferably about 1.5 to 2 mm, the density in bulk of this solid being from about 0.5 to 0.9 and more particularly from about 0.5 to 0.8.

The catalyst of reforming zone $R_4$ descends through the zone and exits and is passed to catalyst regeneration zone CR via line 44 and transfer conduit 45 where accumulated carbon is burned-off at conventional conditions. Regeneration zone CR represents all of the steps required to remove at least a portion of the carbon from the catalyst and return it to the state needed for the reforming reactions occurring in reforming zone $R_4$. The specific steps included in CR will vary with the selected catalyst. The only required step is one where accumulated carbon is burned-off at temperatures from about 600° to 1200° F. and in the presence of an oxygen-containing gas, preferably air. Additional steps which may also be contained in the catalyst regeneration equipment represented by CR include, but are not limited to, adding a halide to the catalyst, purging carbon oxides, redispersing metals, and adding sulfur or other compounds to lower the rate of cracking when the catalyst first enters the reforming zone.

The regenerated catalyst is then charged to reforming zone $R_4$ via line 42 and the cycle of continuous catalyst regeneration is continued until the entire reforming unit (both stages) is shut down, such as for catalyst regeneration of first stage reforming, for example when the first stage reforming zones are fixed bed semi-regenerative reactors. It is to be understood that the catalyst in the moving-bed reforming and regeneration zones may not be constantly moved, but may only move intermittently through the system. This may be caused by the opening an closing of various valves in the system. Thus, the word "continuous" is not to be taken literally and the word "continual" is sometimes used interchangeably with "continuous".

The moving-bed zones of the second stage may be arranged in series, side-by-side, each of them containing a reforming catalyst bed slowly flowing downwardly, as mentioned above, either continuously or, more generally, periodically, said bed forming an uninterrupted column of catalyst particles. The moving bed zones may also be vertically stacked in a single reactor, one above the other, so as to ensure the downward flow of catalyst by gravity from the upper zone to the next below. The reactor then consists of reaction zones of relatively large sections through which the reactant stream, which is in a gaseous state, flows from the periphery to the center or from the center to the periphery interconnected by catalyst zones of relatively small sections, the reactant stream issuing from one catalyst zone of large section divided into a first portion (preferably from 1 to 10%) passing through a reaction zone of small section for feeding the subsequent reaction zone of large section and a second portion (preferably from 99 to 90%) sent to a thermal exchange zone and admixed again to the first portion of the reactant stream at the inlet of the subsequent catalyst zone of large section.

When using one or more reaction zones with a moving bed of catalyst, said zones as well as the regeneration zone, are generally at different levels. It is therefore necessary to ensure several times the transportation of the catalyst from one relatively low point to a relatively high point, for example from the bottom of a reaction zone to the top of the regeneration zone, said transportation being achieved by any lifting device simply called "lift". The fluid of the lift used for conveying the catalyst may be any convenient gas, for example nitrogen or still for example hydrogen and more particularly purified hydrogen or recycle hydrogen.

Catalysts suitable of use in any of the reactors of any of the stages include both monofunctional and bifunctional, monometallic and multimetallic noble metal containing reforming catalysts. Preferred are the bifunctional reforming catalysts comprised of a hydrogenation-dehydrogenation function and an acid function. The acid function, which is important for isomerization reactions, is thought to be associated with a material of the porous, adsorptive, refractory oxide type which serves as the support, or carrier, for the metal component, usually a Group VIII noble metal, preferably Pt, to which is generally attributed the hydrogenation-dehydrogenation function. The preferred support for both stages of reforming is an alumina material, more preferably gamma alumina. It is understood that the support material for the second stage reforming must be in the form of spherical particles as previously described. One or more promoter metals selected from metals of Groups IIIA, IVA, IB, VIB, and VIIB of the Periodic Table of the Elements may also be present. The promoter metal, can be present in the form of an oxide, sulfide, or in the elemental state in an amount from about 0.01 to about 5 wt. %, preferably from about 0.1 to about 3 wt. %, and more preferably from about 0.2 to about 3 wt. %, calculated on an elemental basis, and based on total weight of the catalyst composition. It is also preferred that the catalyst compositions have a relatively high surface area, for example, about 100 to 250 $m^2/g$. The Periodic Table of which all the Groups herein refer to can be found on the last page of Advanced Inorganic Chemistry, 2nd Edition, 1966, Interscience publishers, by Cotton and Wilkinson.

The halide component which contributes to the necessary acid functionality of the catalyst may be fluoride, chloride, iodide bromide, or mixtures thereof. Of these, fluoride, and particularly chloride, are preferred. Generally, the amount of halide is such that the final catalyst composition will contain from about 0.1 to about 3.5 wt. %, preferably from about 0.5 to about 1.5 wt. % of halogen calculated on an elemental basis.

Preferably, the platinum group metal will be present on the catalyst in an amount from about 0.01 to about 5 wt. %, calculated on an elemental basis, of the final catalytic composition. More preferably, the catalyst comprises from about 0.1 to about 2 wt. % platinum group component, especially about 0.1 to 2 wt. % platinum. Other preferred platinum group metals include palladium, iridium, rhodium, osmium, ruthenium and mixtures thereof.

By practice of the present invention, reforming is conducted more efficiently and results in increased hydrogen and $C_5+$ liquid yields. The first stage reactors are operated at conventional reforming temperatures and pressures in semiregenerative or cyclic mode while the reactors of the second stage are moving bed reactors operated substantially at lower pressures. Such pressures in the second stage may be from as low as about 30 psig to about 100 psig.

Various changes and/or modifications, such as will present themselves to those familiar with the art may be made in the method and apparatus described herein without departing from the spirit of this invention whose scope is commensurate with the following claims.

What is claimed is:

1. A process for catalytically reforming a gasoline boiling range hydrocarbon reactant stream in the presence of hydrogen in a reforming process unit comprised of a plurality of serially connected reforming zones wherein each of the reforming zones contains at least one reforming catalyst containing a Group VIII noble metal on a refractory support, which process comprises:

(a) reforming two reactant streams in a first reforming stage which is comprised of two separate fixed-bed reforming process units each unit comprised of one or more serially connected reforming zones containing a fixed-bed of a catalyst comprised of at least one Group VIII noble metal on a refractory support, which one or more reforming zones are operated at reforming conditions which includes a pressure of about 100 to 500 psig;

(b) passing the resulting effluent streams from both of the two fixed-bed reforming units to a second reforming stage comprised of one or more serially connected reforming zones which are operated in a moving-bed continual catalyst regeneration mode which is operated at pressures from about 30 to 100 psig, wherein the catalyst descends through the reforming zone, exits, and is passed to a regeneration zone where at least a portion of any accumulated carbon is burned-off, and wherein the regenerated catalyst is recycled to the one or more second stage reforming zones;

(c) passing a first portion of the effluent stream from said second stage reforming to a first separation zone wherein a hydrogen-rich gaseous stream and a predominantly $C_5+$ liquid stream are produced, wherein a portion of the hydrogen-rich gaseous stream is recycled to one of the fixed-bed reforming process units, and the remaining portion is collected as product gas, and (d) passing a second portion of said effluent stream from said second stage reforming to a second separation zones wherein a hydrogen-rich gaseous stream and a predominantly $C_5+$ liquid stream are produced, and wherein a portion of the hydrogen-rich gaseous stream is recycled to the other fixed-bed reforming process unit, and the remaining portion is collected as product gas.

2. The process of claim 1 wherein the catalyst in each of the reforming zones of the first stage is comprised of about 0.01 to 5 wt. % platinum, and about 0.01 to 5 wt. % of at least one metal selected from the group consisting of iridium, rhenium, and tin.

3. The process of claim 1 wherein the catalyst of each of the reforming zones of the second stage is comprised of about 0.01 to 5 wt. % platinum, 0.01 to 5 wt. % tin, on substantially spherical particles of a refractory support.

4. The process of claim 3 wherein the amount of platinum and tin are each from about 0.1 to 2 wt. % and the spherical refractory support particles are comprised of alumina.

5. The process of claim 3 wherein the catalyst in each of the first stage reforming zones is comprised of about 0.01 to 5 wt. % platinum, and about 0.01 to 5 wt. % of at least one metal selected from the group consisting of iridium, rhenium, and tin.

6. The process of claim 1 wherein: (i) the first reforming stage contains 2 or 3 fixed-bed reforming zones for each fixed-bed process unit, and (ii) the second reforming stage contains one or two moving-bed reforming zones, with the proviso that when two moving-bed reforming zones are employed, the catalyst descends through a first moving-bed reforming zone, is passed to the second moving-bed reforming zone where it descends through said second moving-bed reforming zones, then is passed to a regeneration zone where any accumulated carbon is burned-off, after which the regenerated catalyst is recycled to said first moving-bed reforming zone.

7. The process of claim 6 wherein: (i) the catalyst in each reforming zone of said first reforming stage is comprised of about 0.01 to 5 wt. % platinum, about 0.01 to 5 wt. % of at least one metal selected from the group consisting of iridium, rhenium, and tin; and (ii) the catalyst in each of the reforming zones of said second stage is comprised of about 0.1 to 2 wt. % platinum, and about 0.1 to 2 wt. % tin on substantially spherical refractory support.

* * * * *